United States Patent [19]

Davis et al.

[11] 4,397,050

[45] Aug. 9, 1983

[54] QUICK SHOWER OR POWER SHOWER

[76] Inventors: Clifford E. S. Davis, c/o George Spector, 3615 Woolworth Bldg., 233 Broadway; George Spector, 3615 Woolworth Bldg., 233 Broadway, both of New York, N.Y. 10007

[21] Appl. No.: 230,670

[22] Filed: Feb. 2, 1981

[51] Int. Cl.[3] ..... A47K 3/22

[52] U.S. Cl. ..... 4/601; 239/381; 4/570; 4/628

[58] Field of Search ..... 4/596, 597, 601, 605, 4/628, 570; 15/21 R, 21 B, 21 D; 239/102, 380–383

[56] References Cited

U.S. PATENT DOCUMENTS

| | | | |
|---|---|---|---|
| 1,220,704 | 3/1917 | Swimmer | 4/601 X |
| 2,772,116 | 11/1956 | Dobkin | 4/628 |
| 3,042,949 | 7/1962 | Mosley | 15/21 R |
| 3,121,235 | 2/1964 | Gellmann | 4/601 X |
| 3,899,130 | 8/1975 | Bell | 239/102 |
| 3,958,756 | 5/1976 | Trenary | 239/102 |
| 3,967,783 | 7/1976 | Halsted | 239/383 X |
| 3,971,074 | 7/1976 | Yxfeldt | 4/601 |
| 4,141,502 | 2/1979 | Grohe | 239/381 |
| 4,209,132 | 6/1980 | Kwan | 239/381 |

*Primary Examiner*—Charles E. Phillips

[57] ABSTRACT

A shower device attachable by suction cups to a wall, such as adjacent a bath tub; the device including a panel supporting a row of adjustable shower heads to each of which water is supplied that is selectively mixed with diluted soap from a soap dispenser mounted on the panel, a pulsator being selectively used to pulsate the sprayed water, and a flexible hose from the device for connection to a water supply faucet valve.

3 Claims, 6 Drawing Figures

12
36
19
12
28
27
18
11
17
18
10
17
14
18
12
13

26
25
21
19
18a
20
22

24a
19
11
23
24

16
15
17
14

13

11
12

30
31
28
34

31
32
29
33
35

QUICK SHOWER OR POWER SHOWER

This invention relates generally to showering equipment.

It is well known that after a day of hard work, a person likes to refresh himself which is best done by a shower, instead only by a scrubbing up at a basin or in a bath tub, especially on a hot summer day.

Accordingly, it is a principal object of the present invention to provide a shower device that is portable so to be used anywhere outdoors or indoors as wished, and which includes a battery of spray heads for directing a refreshing spray of water directly at all parts of the body, instead of only overhead like a conventional spray head in a shower stall.

Another object is to provide a shower device which is adjustable so to selectively include the spraying water that pulsates, if so wished, for additional refreshing feeling, and which also is adjustable so to selectively have the sprayed water contain diluted soap therein, so to eliminate need of handling a separate bar of soap for lathering up.

Figure 1:
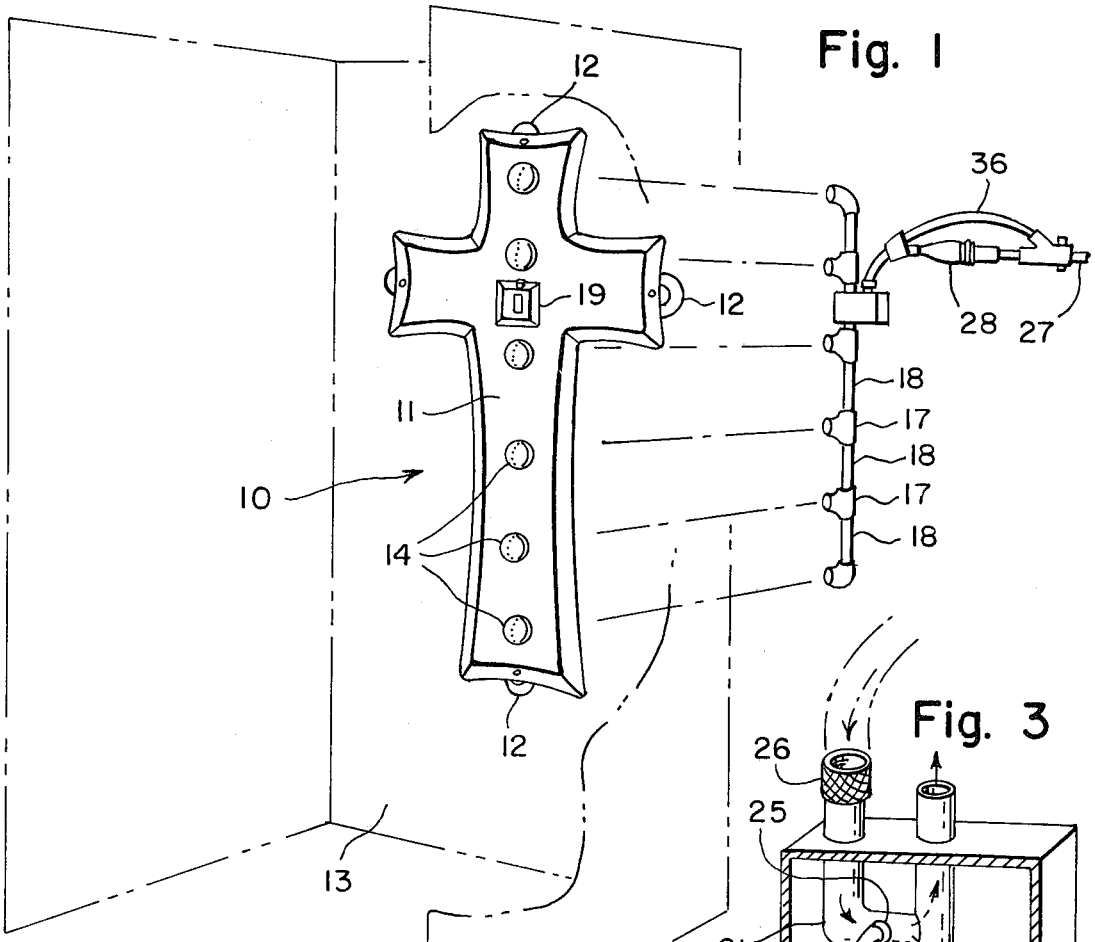
FIG. 1 is a perspective view of the invention shown with water intake pipe separated from the front unit; and showing the device installed by suction cups on a wall of any smooth structure; and the front panel including mounting holes at extremities so to be alternately nailed on a tree or other vertical support.
Figure 3:
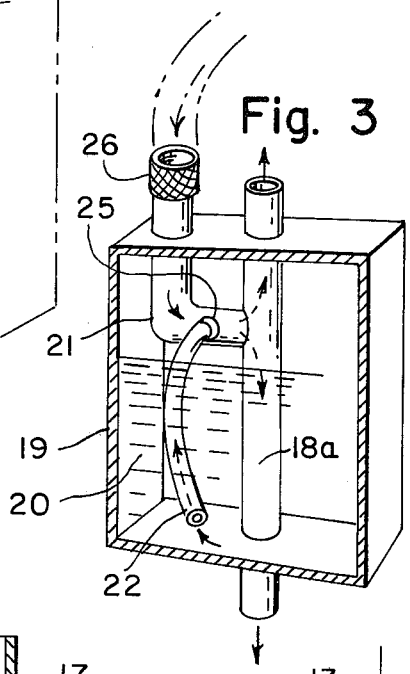
FIG. 3 is a further enlarged detail of the soap dispenser case on a rear side of the front panel.
Figure 2:
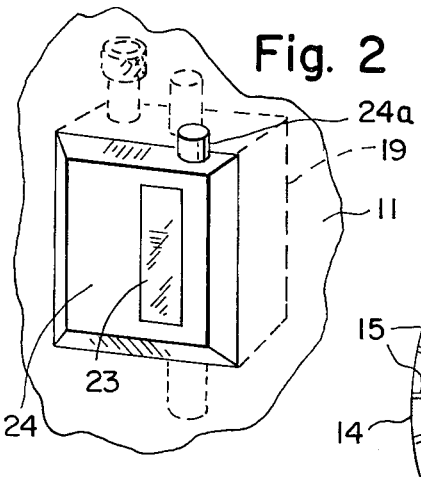
FIG. 2 is an enlarged detail of the soap dispenser as shown in FIG. 1.
Figure 4:
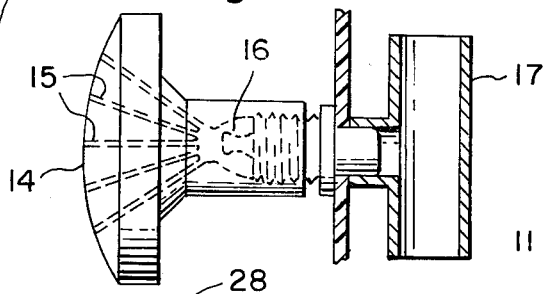
FIG. 4 is an enlarged side cross section of a typical shower head.
Figure 5:
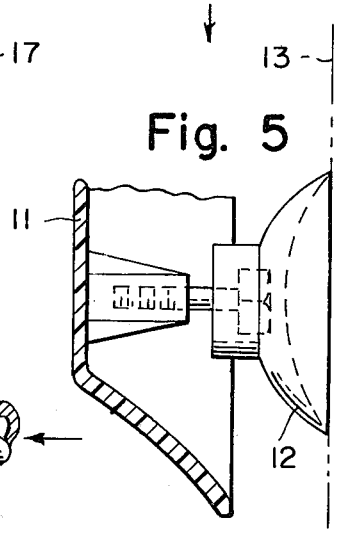
FIG. 5 is an enlarged side view of a typical suction cup.
Figure 6:
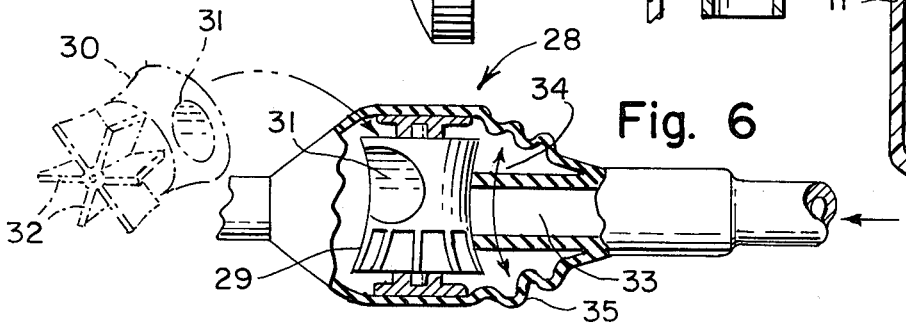
FIG. 6 is a cross sectional view of a water pulsator which can be installed at the water intake so to give a refreshing pulsating water pressure against a person's body, the pressure being able to be adjusted.

Referring now to the drawing in greater detail, the reference numeral 10 represents a Quick Shower or Power Shower, according to the present invention, wherein there is a cross-shaped, molded fiberglass panel 11 which has a suction cup 12 at a rear side of each extremity thereof, for support to a vertical wall 13, and which may be adjacent a bathtub or elsewhere, as wished. The device may retailed together with a non-slip tub mat so that even an average six-foot man may stand safely inside a bathtub while showering with the device, and not slip.

A vertical row of spray heads 14 is mounted on the panel so as to direct a spray horizontally against all parts of a person. Each spray head is adjustable for spray intensity, and includes radially extending spray passages 15. The spray head is threaded on a water jet 16 for adjustment. The jets are connected to tees 17 behind the panel; the tees being connected in a line by pipes 18 therebetween.

One of the pipes 18*a* is fitted with a soap dispenser 19 for dispensing liquid soap 20 into the water going to the spray heads. The pipe 18*a* is connected to a water intake elbow 21 from which a syplon hose 22 hangs inside the dispenser and into the liquid soap, so to be syplioned up as the incoming water moves from the elbow to the pipe 18*a* and then to the spray heads. A window 23 on a front cover 24 of the dispenser allows checking the liquid soap level therein. A plug 24*a* closes a refill opening on the cover 24. A backflow valve 25 may be included so to prevent water in the upper passages to drain into the dispenser and dilute the soap.

A hose connector 26 on an end of the elbow provides connection to a water supply hose 27.

This hose may be intercepted by a pulsator 28 which causes the sprayed water to pulsate adjustably. It includes a water wheel 29 integral with a roller 30 having a diametrical hole 31 therethrough so to intermittantly allow the water to pass therethrough in order to cause the pulsation. The roller is rotated by means of a selectively controlled portion of the incoming water to move around the vanes 32 of the water wheel. This control is achieved by manually moving the hose end 33 sidewardly as shown by arrow 34 so more or less water travels around the water wheel, thus regulating rotational speed thereof. The entire assembly is contained inside a flexible rubber case 35 integral at one end with a hose end 33 for easy flexing thereof.

A bypass 36 allows complete elimination of the pulsating action.

In use, it is now evident that a portable and improved showering device is provided.

What is claimed as new, is:

1. A quick pulsating shower device, comprising in combination a panel mounted on a wall, a row of spray heads and a soap dispenser on said panel connected by a hose to a water supply, said hose being intercepted upstream by a pulsator, wherein said soap dispenser includes a syphon hose drawing liquid soap into water moving to said spray heads wherein said pulsator comprises water driven roller means rotatably mounted about an axis at right angles to the conduit axis and having peripheral vanes responsive to water flow in said conduit to cause rotation of said roller means, said roller means further having in combination an orifice through said means causing pulsating intermittant flow through said conduit.

2. A device as in claim 1 including further means for selectively controlling water flow impinging upon said roller means.

3. A device as in claim 8 wherein said further means comprises a flexible cover surrounding a portion of said conduit and roller means.

* * * * *